United States Patent [19]

Bach

[11] Patent Number: 4,854,742

[45] Date of Patent: Aug. 8, 1989

[54] WHEEL BEARING, IN PARTICULAR FOR TOY VEHICLES

[75] Inventor: Erik Bach, Billund, Denmark

[73] Assignee: Interlego A. G., Baar, Switzerland

[21] Appl. No.: 125,345

[22] Filed: Nov. 25, 1987

[30] Foreign Application Priority Data

Nov. 26, 1986 [DK] Denmark ..... 5679/86

[51] Int. Cl.[4] ..... A63H 19/22; B61F 13/00; F16C 41/04; F16C 17/00

[52] U.S. Cl. ..... 384/129; 105/157.2; 105/238.2; 384/158; 384/624; 446/466; 446/469

[58] Field of Search ..... 384/58, 102, 129, 158, 384/295, 296, 416, 428, 439, 440, 442, 443, 624, 627, 548, 549; 301/63 PW, 5.3; 105/182.1, 157.1, 157.2, 1.5, 238.2; 446/469, 466

[56] References Cited

U.S. PATENT DOCUMENTS

| | | | |
|---|---|---|---|
| 2,284,998 | 6/1942 | Varney | 105/157.2 X |
| 3,120,080 | 2/1964 | Hahn | 105/157.2 X |
| 3,611,630 | 10/1971 | Adickes et al. | 446/469 |
| 4,466,215 | 8/1984 | Hanazato | 446/469 |

FOREIGN PATENT DOCUMENTS

| | | | |
|---|---|---|---|
| 2359389 | 6/1975 | Fed. Rep. of Germany | 384/624 |

*Primary Examiner*—Thomas R. Hannon
*Attorney, Agent, or Firm*—Kane, Dalsimer, Sullivan, Kurucz, Levy, Eisele and Richard

[57] ABSTRACT

A wheel bearing, in particular for toy vehicles, which are usually subjected to strong overloads, is characterized in that, in the vicinity of each end, the wheel axle (10, not shown in FIG. 2) has both a bearing face (14, 15) with a relatively small radius of curvature and a bearing face (12, 13) with a relatively large radius of curvature substantially corresponding to the radius of the axle. The bearings with the small radius of curvature (14, 15) are elastically resilient, the bearing faces with the relatively small radius of curvature being provided in bearing plates (2, 3) which are connected with a vehicle portion (1) via elastic connecting members (4, 5). When the toy vehicle is overloaded, the axle is supported in the large bearings (12, 13) so that the small bearings (14, 15), having a very small friction under normal operating conditions, are not damaged.

3 Claims, 3 Drawing Sheets

WHEEL BEARING, IN PARTICULAR FOR TOY VEHICLES

The invention concerns a wheel bearing, in particular for toy vehicles, comprising a bearing bracket for rotatable reception of a plurality of wheel axles.

It is well-known to reduce bearing friction by means of ball bearings, but this and corresponding solutions have not been used much in connection with toys because of the manufacturing costs and the relatively small physical dimensions. It is likewise known to reduce the bearing friction in simple slide bearings by reducing the mutual speed difference of the cooperating faces, which can be obtained by reducing the bearing diameter. Then, however, the bearings cannot sufficiently withstand the overloading of the wheels when a toy train carriage drives normally, and when a child rests with its weight upon the train carriage.

The object of the invention is to provide a wheel bearing structure which involves very low friction and which is particularly suitable for toy use.

This object is achieved in that the wheel bearing is constructed as stated in the characterizing portion of claim 1, the axles being journalled elastically movably so that very low friction is obtained in normal use and so that, when overloaded, the axles are relieved by some stronger support means preventing destruction of the thin bearings.

Claim 2 defines details in the preferred embodiment, which may comprise either cylindrical bearing pins, as stated in claim 3, or pointed bearings, as stated in claim 4.

Figure 1:
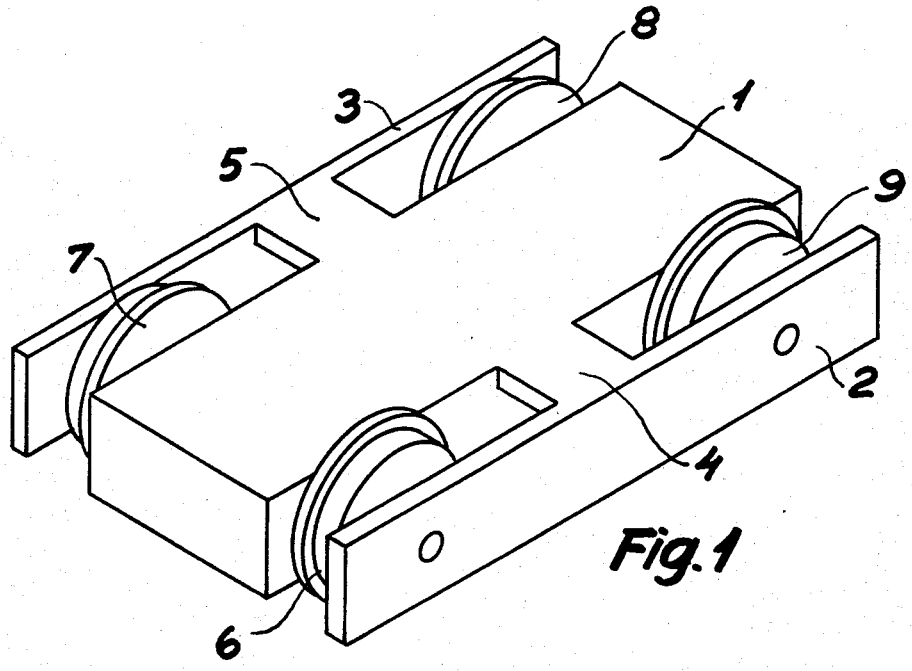
Figure 2:
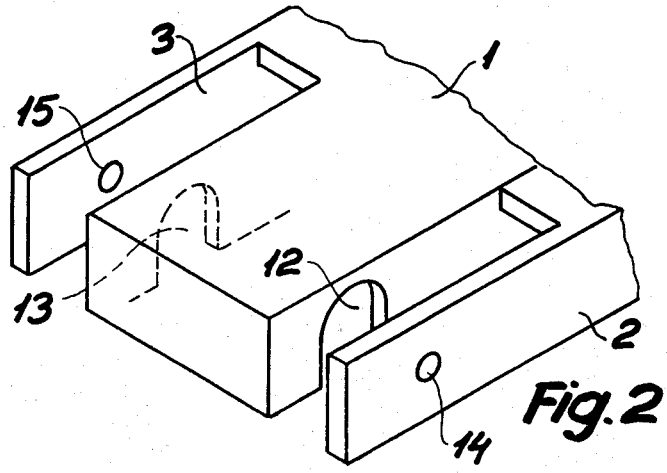
Figure 3:
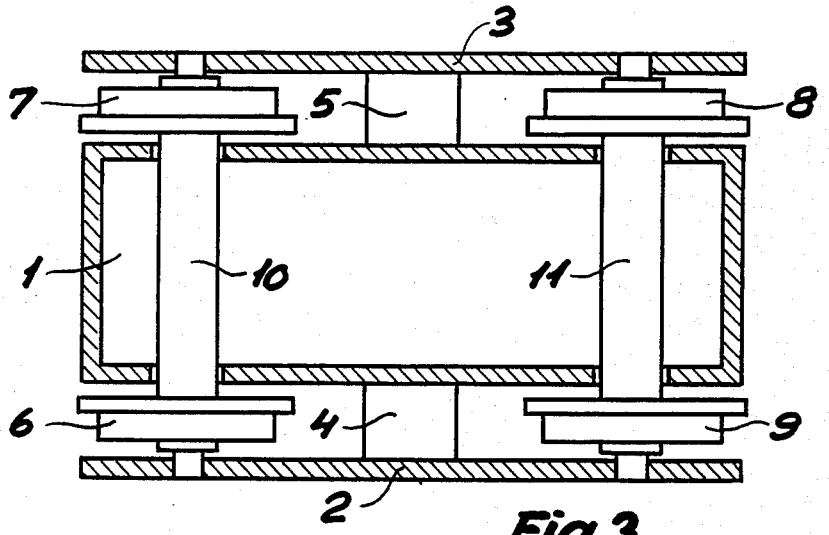
Figure 4:
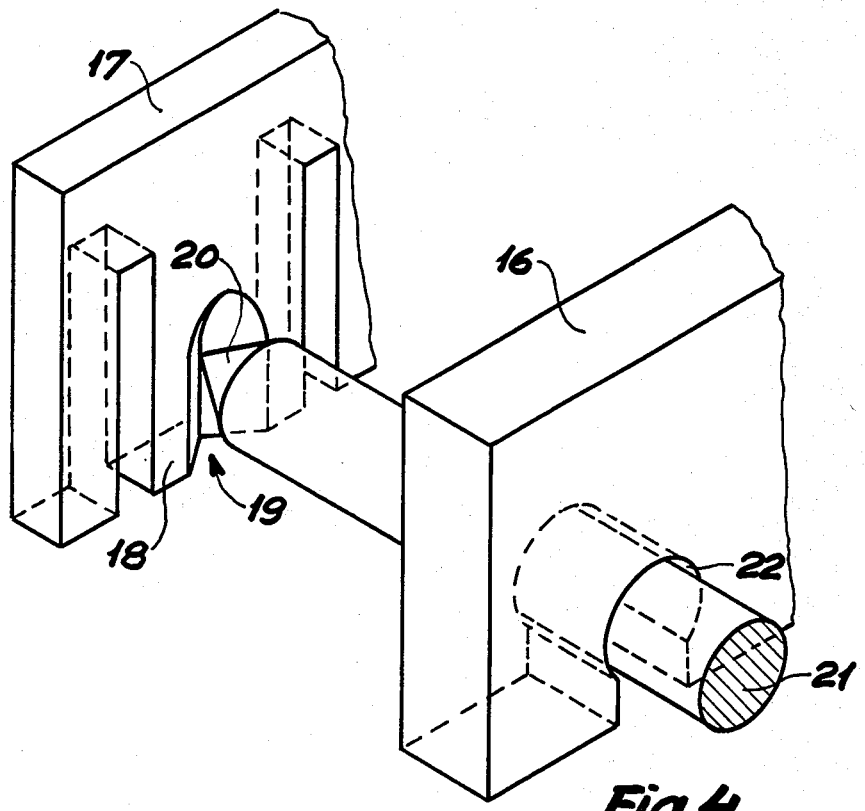
Figure 5:
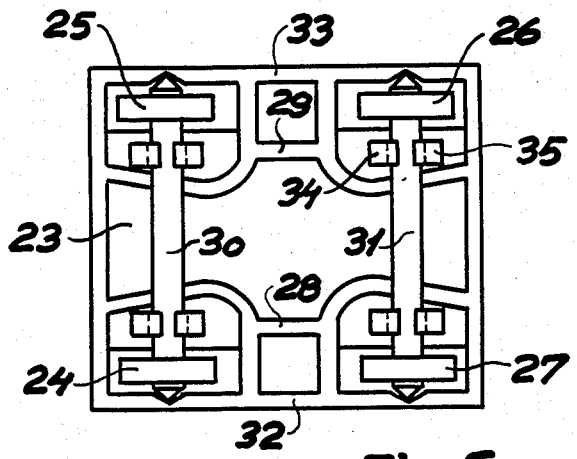

The invention will be explained more fully by the following description of some embodiments with reference to the drawings, in which FIG. 1 is a perspective view of a train bogie, in particular for a toy train whose wheels are journalled in accordance with the invention, FIG. 2 shows one end of the train bogie of FIG. 1 without wheels, FIG. 3 is a bottom view of the train bogie with wheels, FIG. 4 shows another embodiment of one of the axle bearings, while FIG. 5 is a bottom view of another embodiment of a train bogie.

The train bogie shown in FIG. 1 comprises a box-shaped body 1 and two bearing plates 2, 3, which are parallel with long sides of the body. The bearing plates are connected with the body via elastic connecting plates 4, 5. The wheels 6–9 are secured in pairs to a rigid axle 10 and 11, respectively, as shown in FIG. 3.

FIG. 2 shows one end of the bogie without a wheel axle, and it appears clearly that the side members of the body have a pair of cuts 12, 13 whose common central axis is flush with a pair of small holes 14, 15 in the bearing plates 2, 3. The cuts 12, 13 have a radius of curvature corresponding to the radius of the axles and are slightly spaced from the axle under normal loading of the bogie. As appears from FIG. 3, the outer ends of the axle are turned down to a relatively small diameter which fits the bearing holes 14, 15. Thus, there is produced a bearing with a very low friction; however, the bearing is then very fragile and may break upon heavy overloading. According to the invention, the bearing plates 2, 3 are elastically secured to the body 1 so that a strong vertical pressure on the body 1 causes the connecting plates to deflect, so that the axles rest on the internal side of the cuts 12, 13 which serves as a bearing face.

FIG. 4 shows another embodiment of a bearing set consisting of bearing faces having a relatively large and a relatively small radius of curvature, respectively. The shown part 16 corresponds to the side members on the body in the embodiment described above, while the shown part 17 represents another plate rigidly connected with the bogie. An elastic tongue is punched in the plate 17, the inner side of said tongue being downwardly formed with a track 19 which is adapted to receive a pointed tip 20 at the end of an axle 21 (whose wheel is not shown). As shown in FIG. 4, the plate part 16 has a relatively large cut 22 which is slightly spaced from the axle 21 under normal loading conditions. When the train bogie is overloaded, the pointed tip works somewhat higher up in the track 19, the tongue 18 being able to move slightly away from the plate portion 16, so that the axle 21 is caught by the bearing face inside the cut 22. Thus, it is obtained in the same manner as explained in the foregoing that the thin pointed bearing, which has a very small frictional resistance, is relieved.

It is observed that the part 17 in FIG. 4 might itself be an elastic side member of a train bogie, so that it is not necessary to provide the tongue 18. Such an embodiment is shown at the bottom of FIG. 5.

The train bogie in FIG. 5 comprises an upper plate 23 having rectangular holes to receive the wheels 24–27. A pattern of reinforcing ribs extends outwardly from the underside of the plate 23, i.e. out from the plane of the paper in FIG. 5. Thus, the reinforcing ribs comprise the walls 28, 29, which have two pairs of opposed cuts to receive the axles 30, 31. The side walls 32, 33 of the bogie are formed with two pairs of opposed tracks to receive respective pointed tips at the ends of the axles, as appears from the figure. Further, four pairs of bearing pedestals are provided, such as those indicated at 34, 35, which serve both as a bearing face with a relatively large diameter in the same manner as the cut 22 in FIG. 4 and also to secure the axles from dropping out of the bearing tracks. With suitable dimensioning and selection of elasticity of the side walls 32, 33, the operation of the embodiment of FIG. 5 is the same as explained in connection with FIG. 4.

I claim:

1. A wheel bearing, in particular for toy vehicles comprising a bearing bracket for rotatable reception of a plurality of wheel axles, wherein two sets of cooperating bearing faces are provided for each wheel axle, said bearing faces having mutually different radii of curvature, and the axle and the bracket are mutually moveable in a direction transversely to the axle between a position in which the axle is just journalled in bearing faces having a relatively small radius of curvature, and an extreme position in which the axle cooperates with bearing faces having a relatively large radius of curvature, and through-going wheel axles with a pair of wheels in the vicinity of the ends of the axles, characterized in that the outer ends of the wheel axle have a reduced diameter, and that these ends are journalled in a bearing plate secured to the bracket in such manner that a certain elastic travel of said bearing plate is possible, and that the bracket has fixed bearing pedestals opposite the relatively thick portion of the axle, said bearing pedestals limiting the elastic travel area of the axle to define the extreme position of the axle.

2. A wheel bearing according to claim 1, characterized in that each bearing plate is formed with a transversely extending, cylindrical hole in alignment with the associated axle to receive a cylinder-shaped axle end with a relatively small diameter, said bearing plate being secured to the bracket so as to be elastically movable substantially in a vertical direction.

3. A wheel bearing according to claim 1, characterized in that each bearing plate has the shape of a tongue disposed transversely to the associated axle and projecting elastically from the bracket, said tongue having a track to receive an axle end formed with a pointed tip.

* * * * *